US008695254B2

(12) United States Patent
Bell et al.

(10) Patent No.: US 8,695,254 B2
(45) Date of Patent: Apr. 15, 2014

(54) CUSTOMIZABLE DISPLAY AND METHOD FOR SECURELY DISPLAYING INFORMATION

(75) Inventors: Ben H. Bell, Avondale Estates, GA (US); Jeff B. Cobb, Atlanta, GA (US)

(73) Assignee: APCO Graphics, Inc., Atlanta, GA (US)

( * ) Notice: Subject to any disclaimer, the term of this patent is extended or adjusted under 35 U.S.C. 154(b) by 299 days.

(21) Appl. No.: 13/095,667

(22) Filed: Apr. 27, 2011

(65) Prior Publication Data

US 2012/0272553 A1 Nov. 1, 2012

(51) Int. Cl.
*G09F 11/00* (2006.01)

(52) U.S. Cl.
USPC ..... 40/611.08; 40/491; 40/653; D20/18; 116/324

(58) Field of Classification Search
USPC ..... 40/488, 490, 491; 70/58, 78, 77, 81–84, 70/89, 158
See application file for complete search history.

(56) References Cited

U.S. PATENT DOCUMENTS

| | | | | |
|---|---|---|---|---|
| 362,926 | A | | 5/1887 | Benninhaus et al. |
| 588,254 | A | | 8/1897 | Walker |
| 1,101,826 | A | | 6/1914 | Woolums |
| 2,951,301 | A | | 9/1960 | Slavsky |
| 3,199,238 | A | | 8/1965 | Brown |
| 3,314,548 | A | | 4/1967 | Stewart |
| 3,604,133 | A | | 9/1971 | Hawa |
| 3,824,722 | A | | 7/1974 | Maruscak et al. |
| D241,181 | S | | 8/1976 | Jenks |
| 4,184,277 | A | * | 1/1980 | Larin ..... 40/661.01 |
| 4,344,244 | A | * | 8/1982 | Tyke ..... 40/611.05 |
| 4,593,486 | A | * | 6/1986 | Visocky et al. ..... 40/490 |
| 4,682,430 | A | | 7/1987 | Ramsay |
| 5,253,441 | A | | 10/1993 | Rachiele et al. |
| 5,257,595 | A | | 11/1993 | Cassidy, Jr. |
| D351,423 | S | | 10/1994 | Cassidy |
| 5,369,899 | A | * | 12/1994 | Reeves ..... 40/1.5 |
| D375,526 | S | | 11/1996 | Londino |
| 5,608,979 | A | | 3/1997 | Johnson |
| 5,987,794 | A | * | 11/1999 | Lavi et al. ..... 40/611.04 |
| D452,710 | S | | 1/2002 | Ragot |
| 6,658,777 | B2 | | 12/2003 | Dundorf |

(Continued)

OTHER PUBLICATIONS

Patient Room Plaque Details, Signets, Inc., Mentor Ohio, dated at least as early as May 2, 2011.

(Continued)

*Primary Examiner* — Shin Kim
(74) *Attorney, Agent, or Firm* — Rachel H. Huffstetler; FisherBroyles, LLP

(57) ABSTRACT

A customizable display and method for selectively and securely displaying important information, such as a sign for use in healthcare environments. The display includes a cover and a frame assembly. The frame assembly includes a frame, which supports a plurality of tracks, and a plurality of slides positioned on the tracks. The slides receive interchangeable indicia plates, which bear the important information wherein the slides are positioned behind the cover to selectively display the interchangeable indicia plates. The frame defines a locking channel for receiving a locking system having at least one elongate locking member for cooperating with a slide coupling to secure the slides in the extended or concealed position. The slides are biased in the concealed and extended positions and the locking system is obscured by the cover to prevent unauthorized or accidental movement of the slides to alter the displayed information.

53 Claims, 11 Drawing Sheets

(56) References Cited

U.S. PATENT DOCUMENTS

| | | | |
|---|---|---|---|
| 6,978,565 | B1 | 12/2005 | Tollius |
| 7,146,758 | B1 | 12/2006 | Gaston |
| D537,117 | S | 2/2007 | Sinclaire et al. |
| D544,040 | S | 6/2007 | Burns |
| 7,263,669 | B2 | 8/2007 | Denholm |
| 7,363,738 | B2 | 4/2008 | Burtch |
| 7,703,409 | B2 | 4/2010 | Sinclaire et al. |
| D620,052 | S | 7/2010 | Blue et al. |
| D640,748 | S | 6/2011 | Weinstein et al. |
| 8,127,478 | B2 * | 3/2012 | Blue et al. ..... 40/649 |
| 2001/0045037 | A1 | 11/2001 | Bank et al. |
| 2003/0029064 | A1 | 2/2003 | Gordon et al. |
| 2006/0225324 | A1 | 10/2006 | Culiver |
| 2010/0199532 | A1 | 8/2010 | Blue et al. |
| 2012/0124871 | A1 | 5/2012 | Blue et al. |

OTHER PUBLICATIONS

Patient Room Plaque Details; Signets Inc., Mentor, Ohio.

* cited by examiner

CUSTOMIZABLE DISPLAY AND METHOD FOR SECURELY DISPLAYING INFORMATION

FIELD OF THE INVENTION

The present invention generally relates to a customizable display in the form of a mountable sign and a method for selectively and securely displaying interchangeable, critical information in the form of indicia, text and/or color coding, such as a patient information sign used in healthcare environments.

BACKGROUND OF THE INVENTION

Interchangeable signs that are selectively manipulated by designated personnel are particularly advantageous in environments where information is critical to the safety of persons and/or the property itself. For example, in healthcare environments, such as hospitals, relaying important patient information is paramount to lowering the rate of avoidable medical errors. Transmission of relevant information is obviously necessary to improve health outcomes, but is also necessary to meet legal, professional and ethical requirements. It is common for healthcare systems to have built-in redundancies and methods to prevent caregiver errors. A prominent display of critical information is also crucial to aid non-clinical persons in supporting, evaluating and advancing patient care. Examples of non-clinical persons include those involved in the administration of the facility as well as visitors to the healthcare facility. As part of such systems, prominently displayed signs that are easily interpreted can be effective tools to convey important information to healthcare providers and the general public to reduce medical errors and improve patient safety and medical outcomes. It is imperative, particularly when the information is more critical to medical outcomes, for the sign to convey information that is current, reliable and the same across various applications. Each piece of information displayed should have clear meaning and acceptable practices associated with it.

More specifically, hospitals manage patient information electronically through the use of integrated computer systems and computer terminals. However, not all personnel, and certainly not visitors, have access to such systems. Additionally, patient charts are often used to convey specific information about a particular patient, but the physical chart must be accessible and those obtaining the chart must have the experience to interpret them. Moreover, conveying information among hospital personnel is critical both among the healthcare staff currently assisting the patient and those that will come into contact with the patient in the future, such as on subsequent hospital shifts. There remains a need to convey basic, yet very important, information about the patient to each person coming into contact with the patient, be it to provide care, administrative services, or even just visiting. Important patient information, in many cases, must be brought to the attention of all who encounter the patient or the patient's room.

In a hospital setting, for example, critical patient information might include notice that no visitors are allowed or that an interpreter is required. It might also be critical for hospital personnel and visitors to know that masks and gowns are required or to see the nurses' station before entering. Notification that no flowers are permitted or that the patient has a latex allergy may also be critical information that must be displayed. Other examples include that the patient cannot receive anything by mouth or that the patient possesses a fall risk. In certain circumstances, this information is important, and even critical, and should be prominently displayed for all those that approach the patient's room or the patient. And this information should be displayed in a manner that is consistent across various applications as part of a system of transmitting information. Moreover, it is important that the signs possess a degree of integrity so that they may provide a reliable manner of transmitting information. Unintentional and/or unauthorized alteration of the sign must, therefore, be discouraged and even prevented.

U.S. Patent Application Ser. No. 2010/0199532 sets forth a messaging sign having plates and a reversible locking system. The sign according to the prior application consists of a frame formed of various layers positioned in a facing relationship so as to define slots on an outer surface of the frame. Plates bearing indicia are inserted into the slots and secured in place by locking members in the concealed position (that is, fully within the frame). A cover is rotatably mounted to the frame so that the sign may be opened by pivoting the cover to expose the concealed plates. When the plates are concealed within the frame and behind the cover, there is no external indicator of the possible indicia to be displayed, that is, they are fully concealed. Each locking member of each plate must be manually depressed individually to permit the plate to be extended beyond the border of the frame to display those particular indicia.

Such signs are not limited to the healthcare industry. As another example, in industrial settings, interchangeable signs can be used to keep employees informed and to warn of potential dangers to persons and/or property. The signs can display indicia or written content representing, for example, the need for protective eyewear, the presence of propane or other flammable material, the presence of biohazardous materials, high voltage or arc flash areas, moving forklifts, or a food preparation area. It is relevant in such settings to provide a sign which is easily recognizable, which bears standardized warnings in the form of indicia, and which is securely interchangeable by designated personnel. Other settings may also warrant selectively interchangeable and secured signboards, but for the sake of discussion, use of such signs in the healthcare industry will be explained in detail below.

SUMMARY OF THE INVENTION

In accordance with preferred embodiments of the present invention, the present invention obviates shortcomings of the prior art by providing a customizable sign for securely displaying critical information and a method of displaying the information. The display is in the form of a sign that may be mounted to a wall or other structure. The sign includes a cover and a frame assembly. The frame assembly includes frame members secured to one another to form a unitary frame. The frame members are uniquely configured so as to define channels including a locking channel and a fastening channel.

The frame assembly supports one or more horizontal tracks which are secured to the frame members. The tracks include a longitudinally extending, medial flange and a pair of retention tracks extending along side edges thereof. One or more slides, including flanges and shoulders, are provided and cooperate with a respective track. Sufficient tolerances are provided such that the slides move from a concealed position to an extended position along the tracks. The slides support indicia plates which bear the critical information in the form of text, indicia, and/or color coding. Each slide also includes an indicia coupling secured on a rear side thereof which permits the indicia plates to be readily removed and altered and which also cooperates with a locking system to securely display the customized information.

The locking system is provided for preventing unauthorized or unintentional manipulation of the slides within the frame assembly. More specifically, the locking system is positioned within the locking channel of the frame and includes an obscurely positioned actuating pin which, according to one embodiment, extends beyond the frame. The locking system includes a spring which biases the locking system in a locked position and one or more locking elements. The locking elements are configured to mate with one another such that elements may be joined together to achieve a customizable length to accommodate signs with a various number of slides. The locking elements include one or more locking pins which cooperate with the locking guides defined by the indicia coupling.

According to the illustrated embodiment, when a cover is positioned on the frame assembly, the actuating pin is obscured from view. To alter the customizable display, a user must be aware of the obscure position of the actuating pin, reach behind the cover to depress the actuating pin with one hand and then, with the other hand, manipulate the slides so as to display the desired information. According to alternative embodiments, the actuating pin may otherwise be obscured, or even concealed, such as being recessed within the frame. One object of the present invention is to provide a sign that may be easily and securely customizable by providing a locking system which may be unlocked in one step, i.e., by depressing the obscurely positioned actuating pin, wherein substantially all, or a predetermined set, of the slides are released from the locked position and all of the slides are free to move along the respective track. Another object of the present invention is to provide a sign with information that may be the same across various applications. Another objective is to provide a sign that is easy to customize by an authorized user. This is achieved, in one aspect, by the present invention which provides a sign wherein a portion of the each slide extends beyond the edge of the cover such that the authorized user can determine which slides to extend upon unlocking the frame assembly. This is achieved in another aspect, by providing a sign wherein the indicia plates are easily positioned and removed, for example, pulled in an out in a sliding motion, to provide a customizable display. These and other objectives are achieved by the present invention as explained more fully in detail below.

DETAILED DESCRIPTION OF THE INVENTION

The present invention will now be described in detail hereinafter by reference to the accompanying drawings. The invention is not intended to be limited to the embodiments described; rather, this detailed description is provided to enable any person skilled in the art to make and practice. A customizable display 10 in the form of a sign is illustrated in the various figures.

Figure 2:
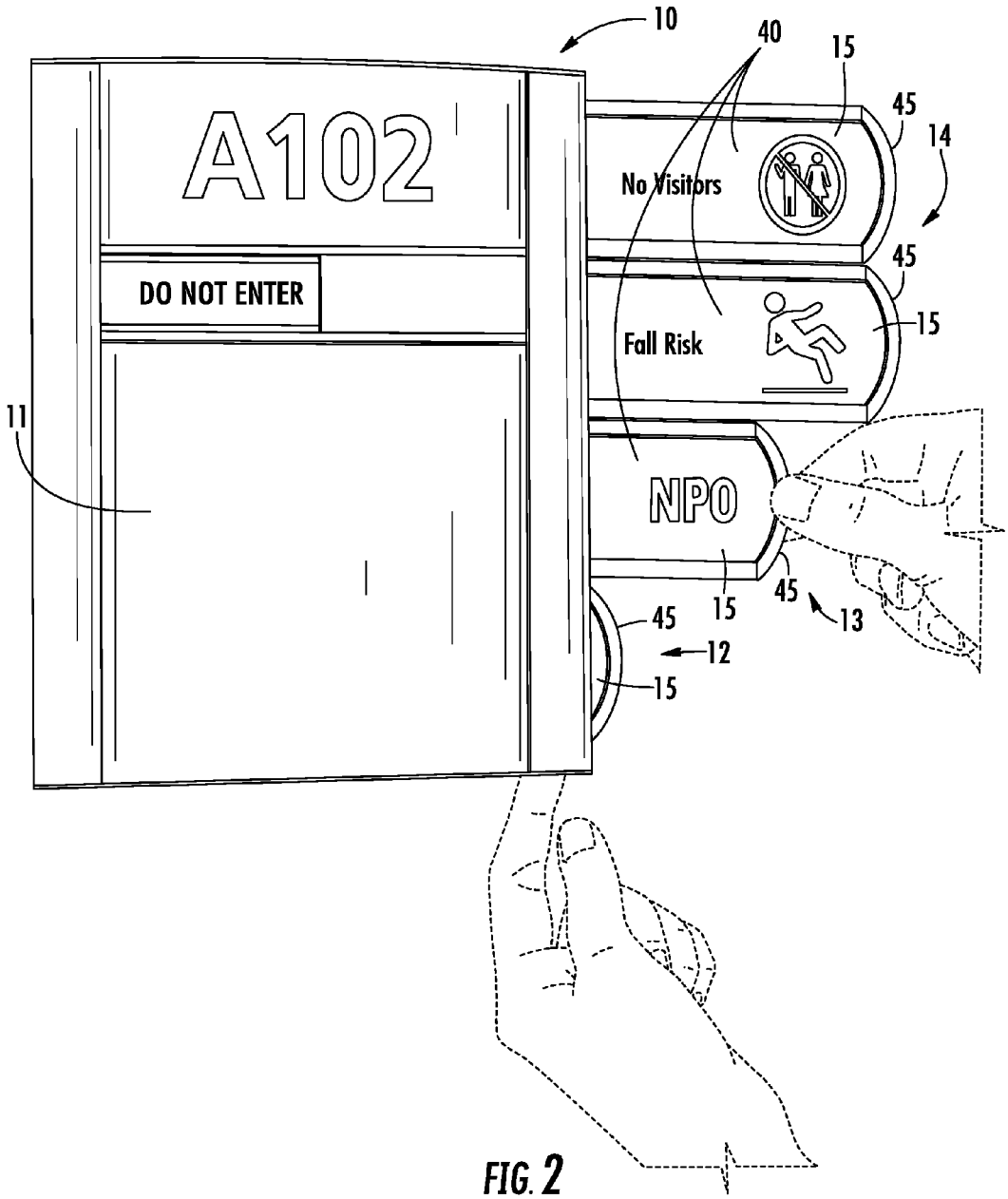
FIG. 2 is a front perspective view of a customizable display.

As shown in FIG. 2, the sign 10 may be mounted to a wall or other structure and includes a decorative cover 11 positioned over a frame assembly 16. Frame assembly 16 supports a plurality of indicia supporting slides 15 and, preferably, a portion of each slide 15 extends from behind the cover 11 in all positions so that a portion is displayed. The frame assembly 16 described herein may be used with various cover 11 designs as would be obvious to one of ordinary skill in the art. An exemplary cover 11 design is illustrated in FIG. 2.

Each slide 15 displays a preselected, and interchangeable indicia plate 40, and is individually moveable between a concealed position 12, shown in FIG. 2, an intermediate position 13, and a fully extended position 14. Each slide 15 includes an aft end 17 and has an indicia coupling 18 secured to one side. Indicia coupling 18 has a fore end 45 which extends beyond the length of slide 15 and defines a manual grip for coupling 18. When the frame assembly 16 is fully assembled and a cover 11 is positioned thereon, as shown in FIG. 2, aft end 17 of slide 15 is positioned behind the cover 11 in the concealed 12 and fully extended 14 positions. Fore end 45 of indicia coupling 18 is exposed in all positions, including the concealed position 12. Locking system 20 is provided to securely display the customizable and critical information as described more fully below.

Indicia plates 40 contain the critical information to be securely displayed. Indicia plates 40 may contain text and/or indicia in the form of symbols as shown in the various figures for use in healthcare environments. Of course, the invention described herein is not limited to the precise text or symbols displayed, but rather is provides as exemplary for the sake of discussion. Indicia plates can also be color-coded. By way of example, for use in a healthcare setting, it may be desirable to utilize the same text, symbols and colors consistently across all application and on each sign 10 utilized as part of a comprehensive information system. According to a preferred embodiment, indicia plates 40 are formed of a pre-printed plastic material. Alternatively, indicia plates 40 may be formed of paperboard or relatively lightweight metal such as aluminum. Indicia plates 40 need not be pre-printed. For example, a wipeable surface for non-permanent marking may be provided. Moreover, the front surface of slides 15 may integrally display relevant information such as when is not desirable to alter the information optionally displayed.

Figure 3:
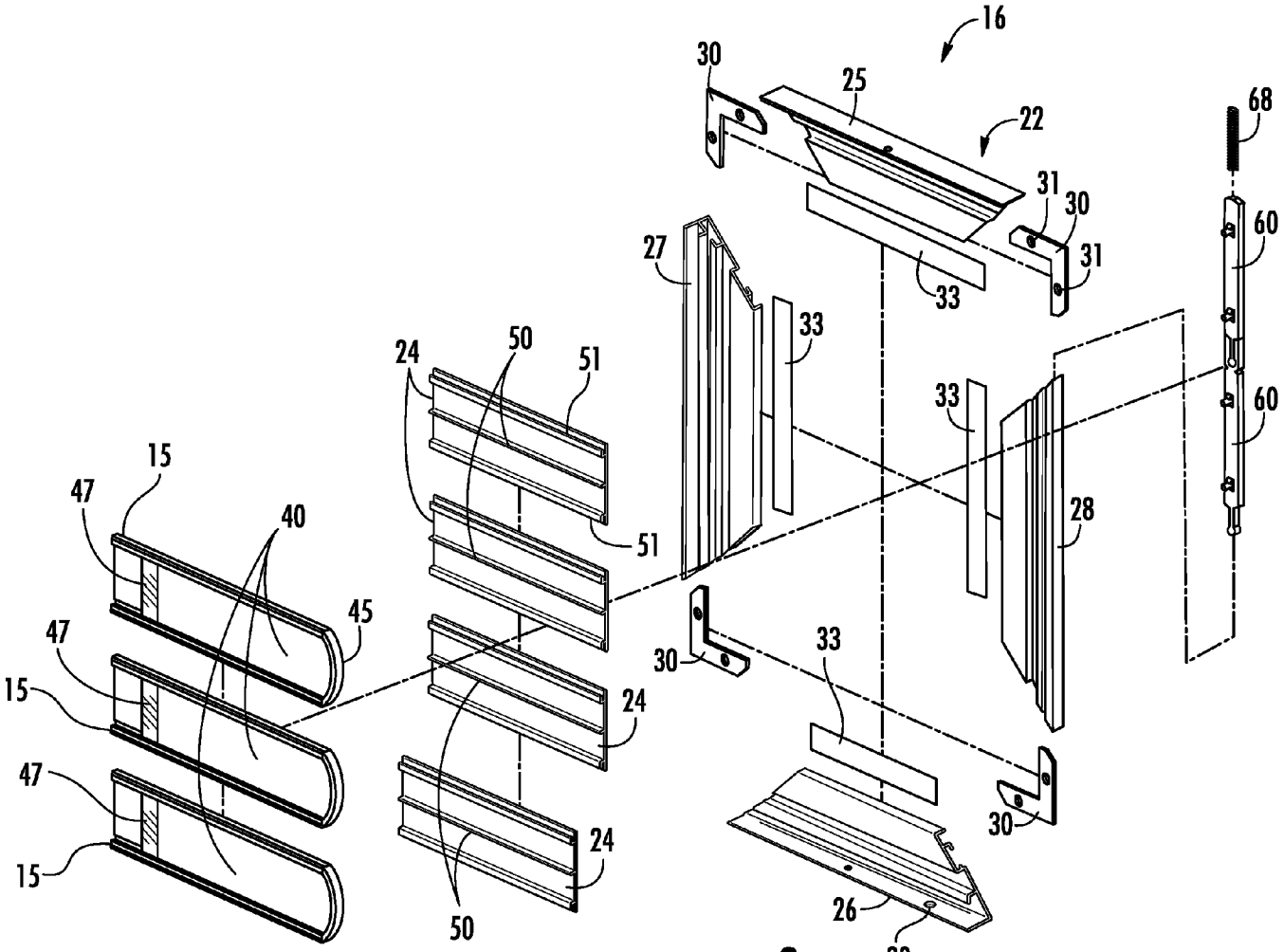
FIG. 3 is an exploded view of a customizable frame assembly.
Figure 4:
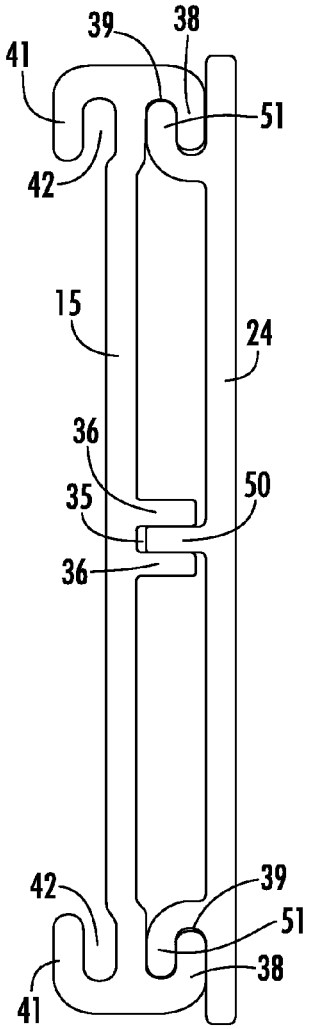
FIG. 4 is a cross section view taken along line 4-4 in FIG. 1 showing the track and slide configuration.
Figure 13:
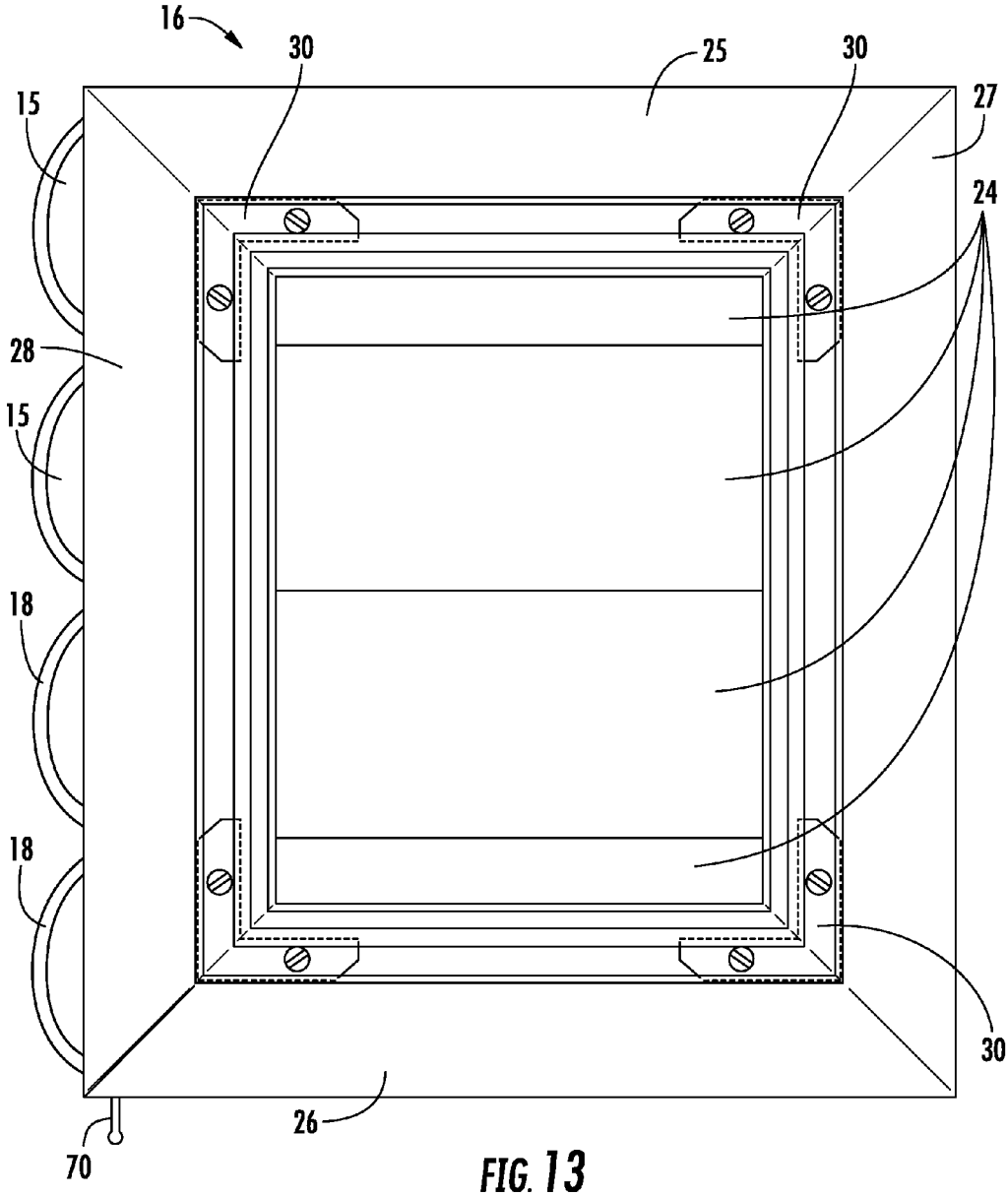
FIG. 13 is a rear view of the frame assembly.

A plurality of tracks 24 are secured to frame assembly 16 by fastening means 33, such as adhesive strips. Tracks 24, once secured to frame assembly 16, define the rear surface of the sign 10 according to a preferred embodiment of the present invention as illustrated in FIG. 13. With reference to FIGS. 3 and 4, tracks 24 each include an upwardly extending flange 50 that extends longitudinally along the length of track 24, along the center thereof. Track 24 also includes a pair of outwardly extending shoulders 51 which extend longitudinally along the length of track 24, along side edges thereof.

Figure 5:
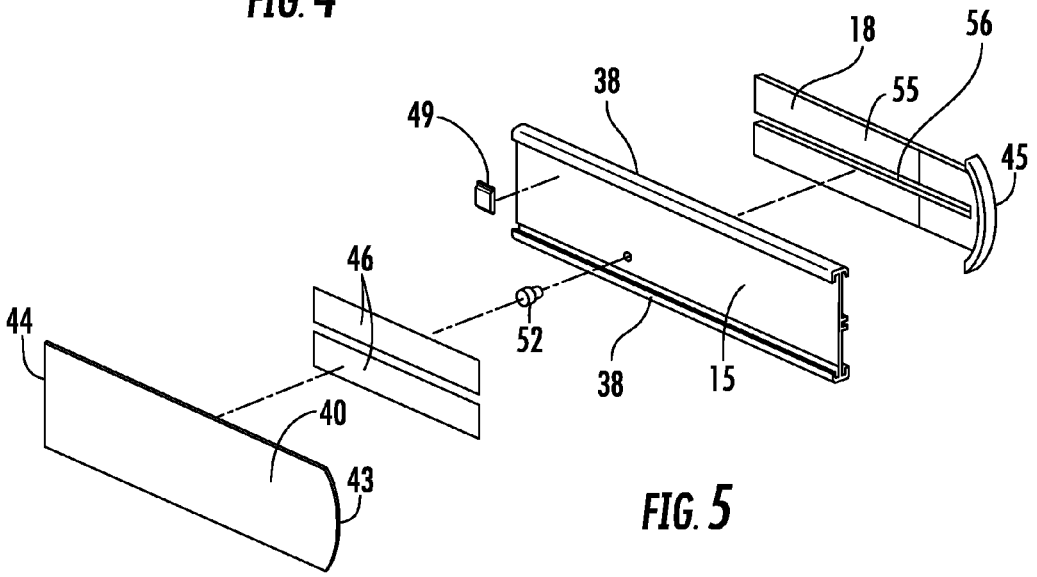
FIG. 5 is an exploded view of an indicia plate bearing slide.

Slide 15 supports indicia plate 40 on a forward side thereof and indicia coupling 18 on its rear side. Slides 15 are configured to positively engage tracks 24. As shown in FIGS. 3 4, and 5, each slide 15 defines a first retention channel 35 defined by a pair of longitudinally extending flanges 36 and configured to receive flange 50 of track 24. Outer edges of each slide 15 facing track 24 each includes a longitudinally extending first shoulder 38 which extends inwardly so as to define second retention tracks 39 for positively engaging correspondingly configured shoulders 51 of track 24. Outer side edges of each slide 15 facing away from track 24 each further define a longitudinally extending second shoulder 41 which extends inwardly for positively engaging indicia plate 40 within third retention tracks 42 defined by second shoulders 41. Sufficient tolerances between mating parts are provided such that slide 15 slides relative to track 24 so as to move between the concealed position 12 and extended position 14.

Indicia plate 40 is optionally secured to the front side of slide 15 with known fasteners, such as, e.g., adhesive strips 46, shown in FIG. 5. Depending upon the frequency of replacing indicia plate 40, however, no fastener is required. Stop 47 is secured to the front surface of 15 by adhesive strip 48 so as to define a positioning guide for indicia plate 40. Two embodiments are illustrated. According to one embodiment, stop 47 shown in FIG. 3, extends substantially across the width of slide 15. According to an alternate embodiment, stop 49, as illustrated in FIG. 5, is provided and which may not extend substantially across the width of slide 15 and which is self-adhered to slide 15. Either slide 47 or 49 may be optically transparent for aesthetic purposes. Accordingly, indicia plate 42 is positioned so that its aft edge 44 abuts stop 47, 49. Its fore edge 43 may extend any desired length, for example, as illustrated, fore edge 43 extends beyond the outer edge of slide 15. Fore edge 43 of indicia plate 42 is received within indicia coupling 18. As illustrated, the fore edge of indicia plate 42 extends beyond the fore edge of slide 15 and is arcuate in configuration. Alternatively, indicia plate 42 may extend to the fore edge of slide 15 or be shorter than slide 15 and may have a different fore configuration, e.g., a straight edge.

Figure 6:
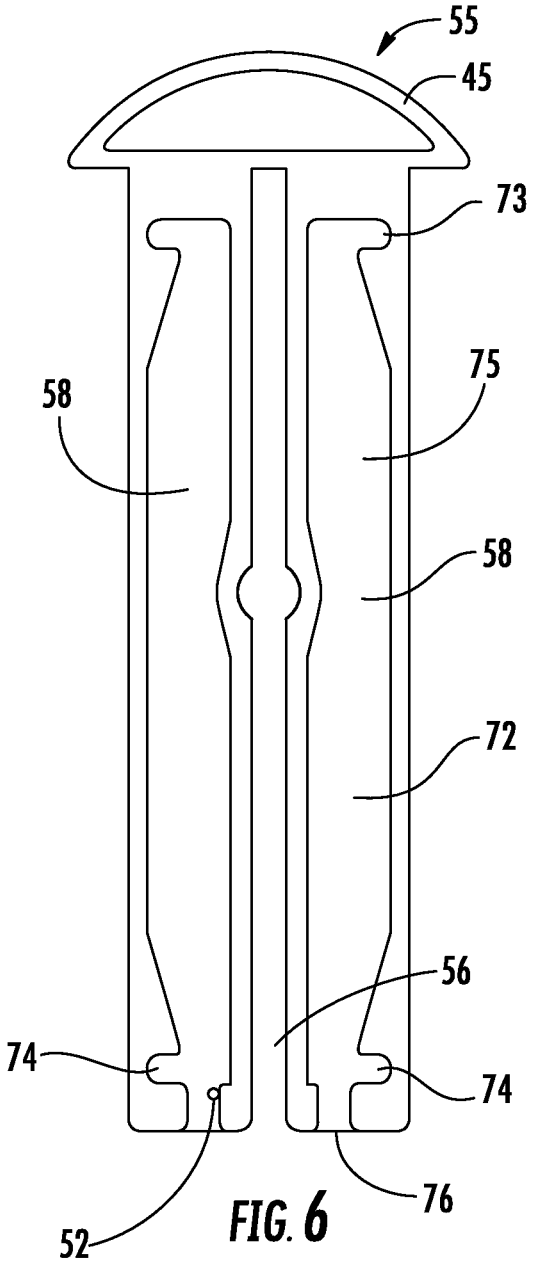
FIG. 6 is a bottom plan view of an indicia coupling.

Indicia coupling 18 is secured to slide 15 by adhesive and, according to a preferred embodiment illustrated in FIG. 6, indicia coupling 18 is a unitary structure formed of a material possessing a degree of inherent flexibility, for example, a plastic. Alternatively (not shown), indicia coupling 18 may be formed of separate parts which may or may not be flexible, but which are connected so as to provide an indicia coupling that has at least a flexible fore edge. Indicia coupling 18 includes fore edge, or grip, 45 for receiving fore edge 43 of indicia plate 40. Indicia coupling 18 includes a longitudinally extending aperture 56 configured to receive flanges 36 of slide 15 as illustrated in FIG. 5. Indicia coupling 18 further includes a pair of locking guides 75, which are uniquely configured so as to cooperate with the locking system 20, explained more fully below.

Figure 7:
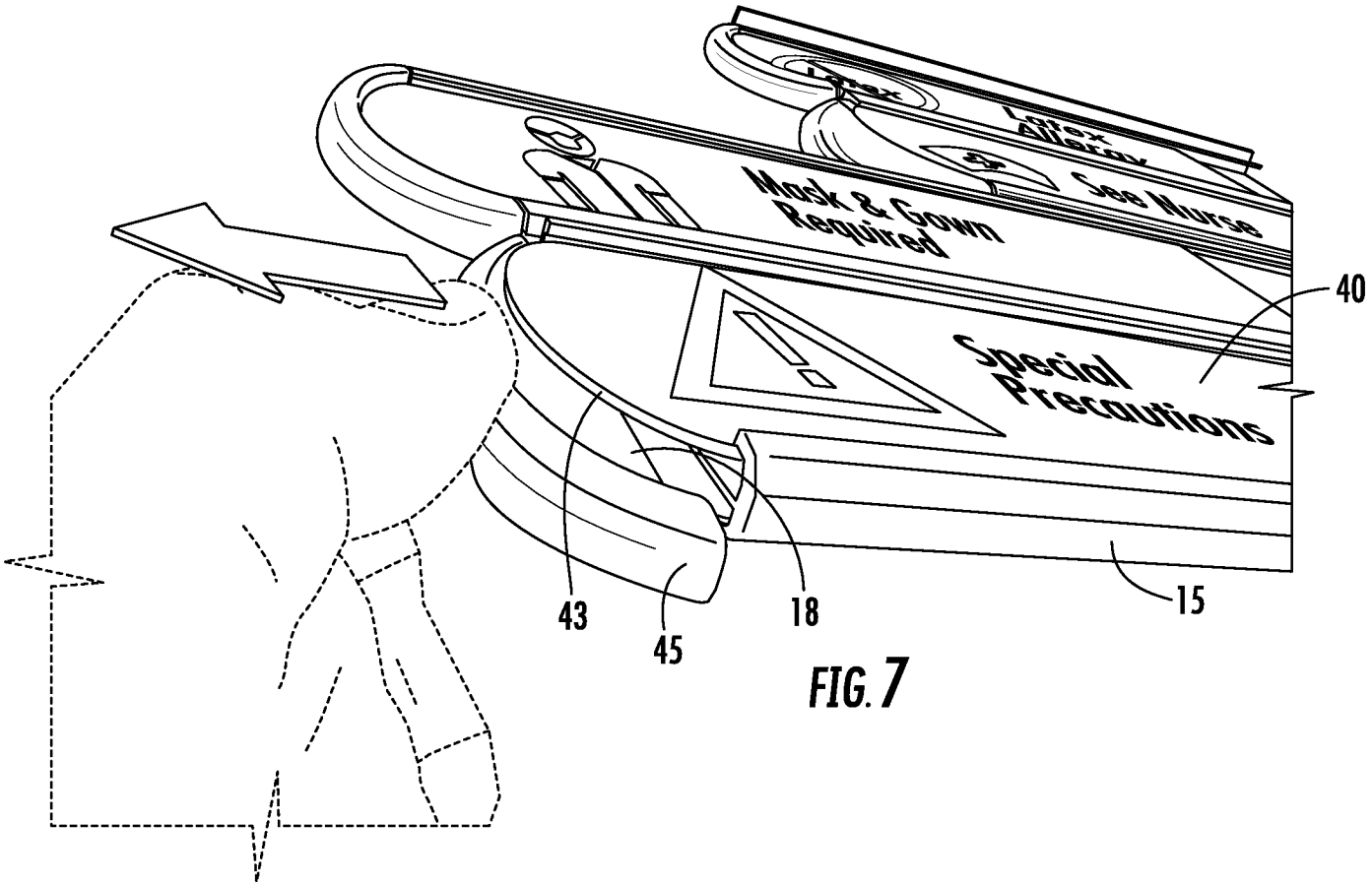
FIG. 7 is a perspective view of the slide and indicia coupling in an open position.

Indicia coupling 18 is preferably pliable to enable the display 10 to be customizable in that various indicia plates 43 may be provided and selectively assembled onto the sign 10. As best shown in FIG. 7, indicia plates 43 may be removed and positioned by applying downward force to grip 45 of indicia coupling 18 whereby indicia plate 40 may be removed by sliding in the direction shown. Indicia plate 40 is similarly inserted by applying downward force to grip 45 and inserting indicia plate and sliding it in the reverse direction. A preselected set of indicia plates 40 may be provided. For example, in a healthcare setting such as a hospital, the hospital administration may provide a set of indicia plates from which caregivers may select from. Therefore, the options are consistent among signs throughout the facility. Alternatively, the indicia plates 40 may be customized so as to be the same across all applications and may even be permanently applied to the slides 15.

Figure 11:
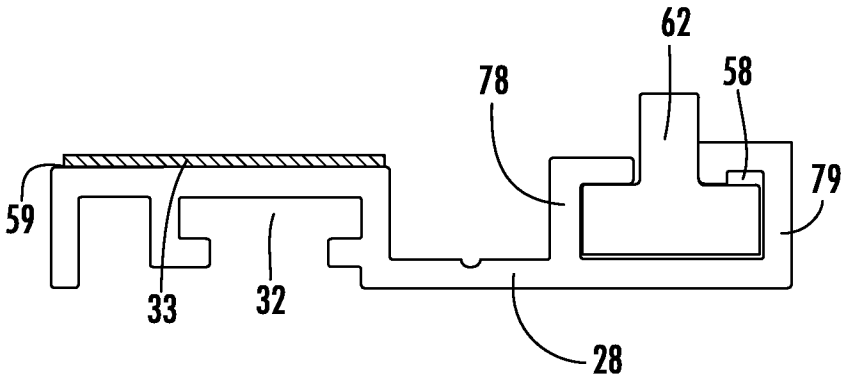
FIG. 11 is a cross section view taken along line 11-11 in FIG. 8.
Figure 12:
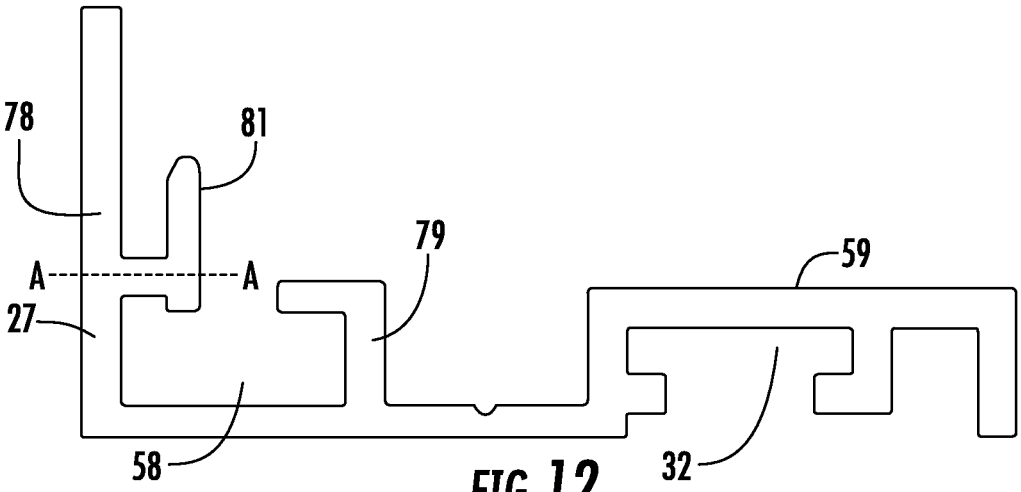
FIG. 12 is a cross section view of line 12-12 in FIG. 8.

Frame 22 includes top 25, bottom 26, first side 27 and second side 28 members. Each member has substantially the same configuration except that second side member 28 has a configuration which is modified by an additional manufacturing step. Alternatively, second side member 28 may be uniquely extruded. FIG. 12 is a cross section view taken along lines 12-12 of FIG. 8, through first side member 27. FIG. 11 is a cross section view of second side member 28 taken along line 11-11 of FIG. 8.

Referring to FIG. 12, first side frame member 27, top frame member 25, and bottom frame member 26 each includes an outer upwardly extending flange 78, configured as shown, defining an outer side therefore. Each frame member also includes an inner, upwardly extending flange 79, configured as shown, which, together with outer flange 78, define locking channel 58 there between. First side member 27, top frame member 25, bottom frame member 26 and second side frame member 28 each also defines, on rear surfaces, channel 32 for receiving angle plate 30. (See also FIG. 13.) Upper surface 59 provides a surface for securing track 24, such as an adhesive strip 33.

Second side member 28 shown differs in that it is formed with an additional step wherein the frame member is sheared along line A-A shown in FIG. 12. This additional step results in shortened flanges 78, 79 permitting slides 15 mounted within frame assembly 16 to move inwardly and outwardly, with sufficient tolerances to slide over second side frame member 28. Locking system 20 (described more fully below) is received within locking channel 58 of second side frame member 28 to prevent unintentional sliding movement of slide 15 from the concealed 12 to extended 14 positions, and vice versa. Locking channels 58 of the remaining frame members 25, 26 and 27, when sign 10 is assembled, remain void of a locking system 20. This arrangement, however, permits all frame members to be similarly manufactured, providing manufacturing and other efficiencies. It is within the scope of the invention, however, to separately extrude second side member 28 to achieve the same result. Alternatively, a separate channel (not shown) may be separately secured to second frame member 28 without departing from the scope of the present invention.

Locking system 20 prevents unauthorized or unintentional display of any indicia plate 40. This is prevented by providing an obscure, hidden locking system 20 which requires knowledge of the method to display the various indicia plates 40 supported on slides 15. According to the embodiment illustrated in FIG. 1, the locking system 20 is obscured from view by cover 11. The user must have knowledge of the existence of the lock, reach behind cover 11 with one hand, and apply pulling forces to the desired slide or slides 15 to move the slide 15 into the extended position 14. As discussed in more detail below, locking system 20 may otherwise be obscured, or even concealed, from view. A desirable feature of the present invention is that portions of each indicia plate 40 are displayed beyond second side member 28 of frame 22 so that the authorized user can ascertain which slides 15 to extend. Moreover, a one step process is provided wherein all of the slides are released from a locked position upon actuation of the locking system.

Figure 8:
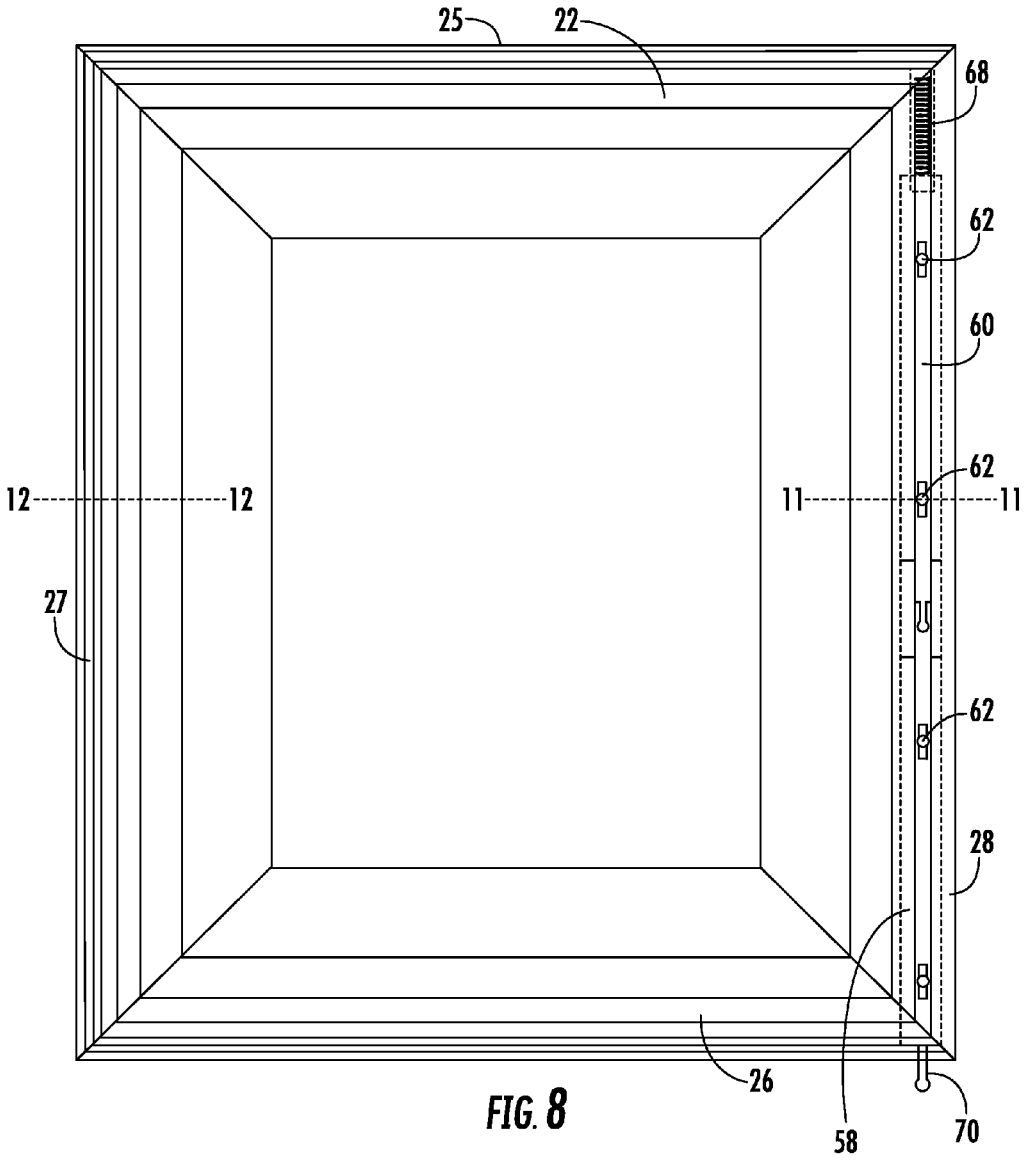
FIG. 8 is a plan view of the frame and illustrating the locking system.
Figure 9:
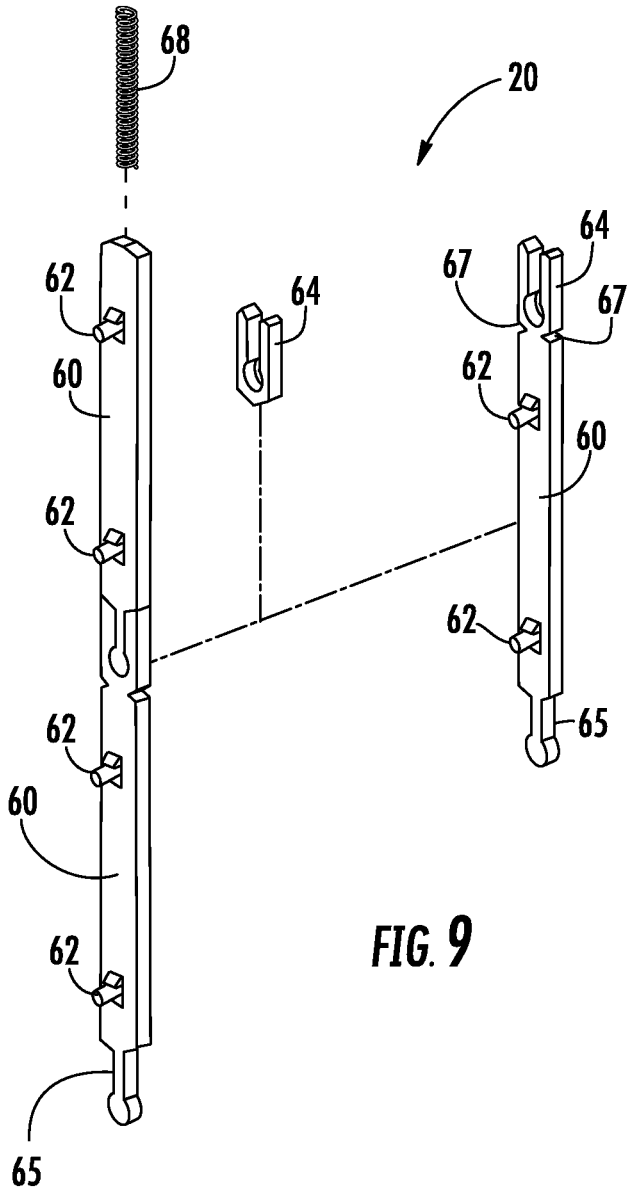
FIG. 9 is an exploded view of the locking system.
Figure 10:
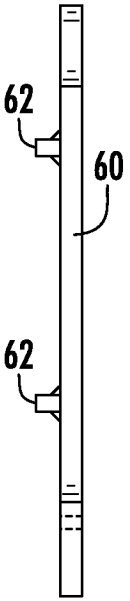
FIG. 10 is a side elevation view of a single locking member.

More specifically, locking system 20 includes one or more elongate locking members 60 shown in FIGS. 8, 9, and 10. With particular reference to FIG. 9, each locking member 60 includes a distal end having a uniquely configured distal connection member 65. At its proximal end, locking member 60 includes a proximal connection member 64 that is configured to receive distal connection member 65. As illustrated, distal connection member 65 is configured with a narrow, elongate member having a bulbous bottom portion. Proximal connection member 65 is correspondingly configured. Of course, any mating configurations may be employed without departing from the scope of the present invention. Accordingly, the length of the locking system 20 may be altered to accommodate signs of varying lengths (that is, with various number of slides 15) or a single locking member 60 of a predetermined length may be provided. When engaged, connection members 64, 65 are configured so that opposing forces applied along its longitudinal axis will not dislodge distal connection member 65 from proximal connection member 64.

Once the desired locking system 20 length is achieved, either by joining two or more locking members 60 or utilizing one locking member 60, the uppermost proximal connection member 64 not engaged with a corresponding distal connection member 65 is removed, such as merely by being manually snapped off of the main body of locking member 60 as shown in FIG. 9. Accordingly, locking member 60 includes indentations 67 to encourage easy removal of proximal connecting member at the desirable location. A proximal connection member 64 which has been removed and the resulting locking member 60 are shown in FIG. 9.

Locking member 60 also includes at least one, and preferably two or more, locking pins 62 extending outwardly from a front surface thereof. As shown in FIGS. 9 and 10, locking pins 62 are substantially cylindrical in configuration, but other protuberance configurations are within the scope of the present invention. Locking system 20 also includes spring 68.

Locking system 20 is received within locking channel 58 defined by second side member 28 of frame 22. As shown in FIG. 8, the number of locking members 60 is selected to achieve a locking system length to accommodate the length of the frame assembly 16, that is, to accommodate a sign 10 with the desired number of slides 15. In the case shown, two locking members 60 are joined by way of the mating of proximal 64 and distal 65 connection members. The uppermost proximal connection member 64 is then removed, either manually or with a tool, to provide an abutment surface 69. Spring 68 is positioned between a surface of top frame member 25 and abutting surface 69. As shown in FIG. 12, spring 68 may abut flange 81 of top frame member 25. Locking system 20 is therefore biased in a downward, direction, i.e. engaged and locked position.

To actuate the locking system 20 whereby slides 15 may move relative to tracks 24, that is, between the concealed and extending positions, pressure is applied to the bottommost distal connecting member 65 that forms an actuating pin 70. Of course, it is within the scope of the present invention to provide an additional member (not shown) attached to the distal connecting member 65 to provide a more prominent actuating pin under certain circumstances. Actuating pin 70 extends through and beyond the bottom frame member 26. An aperture 83, shown in FIG. 3, is provided on bottom frame member 26 to accommodate actuating pin 70. Actuating pin 70 preferably has a length, which is equal to or less than the distance cover 11 extends beyond bottom frame member 26 so that actuating pin 70 is obscured from view. It is within the scope of the present invention to position spring 68 adjacent bottom frame member 26 wherein actuating pin 70 would extend through top frame member 25. It is also within the scope of the present invention to provide actuating pin 70 concealed within frame assembly 16 whereby a tool (not shown) or a user's finger is inserted so to depress actuating pin 70.

Locking system 20 cooperates with indicia coupling 18 to prevent unintentional sliding of slide 15 relative to track 24. As shown in FIGS. 5 and 6, indicia coupling 18 includes, on its bottom surface, longitudinally extending channel 56, which is an aperture configured to receive slide flanges 36 when coupling 18 is secured to slide 15. The outer configuration of coupling 18 includes a fore edge 45 having a width substantially the same as the width of slide 15 and a narrower body length which is less than the slide 15 width to accommodate slide second shoulders 41. Also along its bottom surface, indicia coupling 18 includes at least one locking guide 75 extending substantially along a longitudinal length of coupling 18. Locking guide 75 is configured as a groove or channel defined by indicia coupling 18. Preferably locking guide 75 does not extend through indicia coupling 18 so as to define and aperture, although such constitutes an alternative embodiment of the present invention. As shown, two locking guides 75 are provided to facilitate a left hand and right hand signs 10 as described in more detail below. Set screw 52 is provided in the operative locking guide 75 to prevent complete removal of slide 15. The operative locking guide 75 is the locking guide 75 positioned so as to cooperate with locking system 20.

Referring to FIG. 6, each locking guide 75 comprises a depth having appropriate tolerances to cooperate with locking pin 62 of locking system 20. Locking guide 75 includes a generally elongate medial portion 72 and a proximal locking guide 73 and distal locking guide 74. As shown, side members of elongate medial portions 72 are configured e.g. sloped, to encourage movement of locking pin 62 within the locking guide 75. As shown herein, the sign 10 according to the present invention includes slide 15 and separately applied indicia coupling 18. Such arrangement enables easy customization in that indicia plate 40 is interchangeable. According to an alternative embodiment, however, particularly when it is unnecessary to change indicia plates 40 or when plate 40 is not needed because slide 15 itself conveys the information, a separate coupling 18 may not be provided and slide 15 itself defines locking guides 75. As another alternative, coupling 18 may be provided but may not necessarily be flexible if indicia plates 40 are not utilized or are not changeable.

Locking system 20 prevents unintentional movement of slide 15 as follows. Referring to FIG. 9, one or more locking members 60 are selected to achieve a locking system of a desired length. According to the illustrated embodiment, four slides 15 are provided and, therefore, two locking members 60 are selected. Locking members 60 are joined together via proximal 64 and distal 65 connection members. Proximal member 64 of the uppermost locking member 60 is removed. The connected locking members and spring 68 are then placed within locking channel 58 of second side frame member 28 as shown in FIG. 10 according to the illustrated embodiment. Accordingly, locking system 20 is biased in the downward, or engaged, position. It is, however, within the scope of the present invention to have an upwardly biased locking system. In this position, locking pins 62 of locking members 60 are received within either distal locking guide 74 of indicia coupling 18 when slide 15 is in the extended position 14, or within proximal locking guide 73, when slide 15 is in the concealed position 12.

Figure 1:
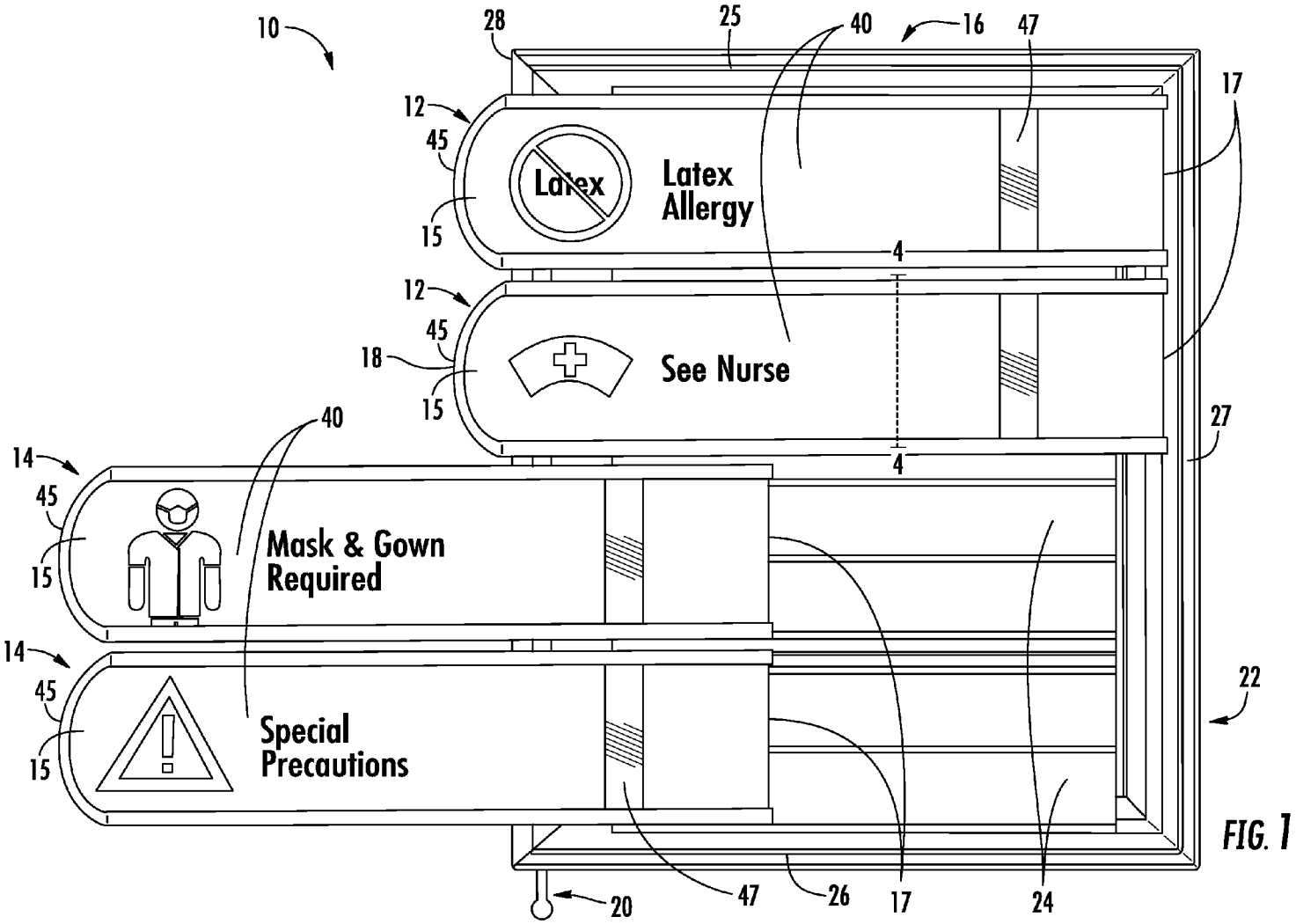
FIG. 1 is a front plan view of a frame assembly used in a customizable display according to a preferred embodiment of the present invention.

Upon depression of spring 68 by forces applied to the exposed actuating pin 70, with regard to slides in the fully extended position, locking pin 62 would slide upward, in the direction of spring 68. Forces may be applied manually or, for heightened security, a specialized tool (not shown) may be provided to manipulate a concealed actuating pin 70. With reference to FIGS. 1 and 6, when slide 15 is fully extended, pin 62, would initially sit within the respective distal locking guide 74 (e.g., left locking guide 75 shown in FIG. 6) having set screw 52. To move slide 15 to a concealed position, forces applied to actuating pin 70, would move locking pin 62 upwardly and therefore out of distal locking guide 74 and into the elongate medial portion 72 of locking guide 75. Slide 15 is then free to slide inward, toward the concealed position under appropriate sliding forces. When slide 15 is moved a distance equivalent to the length of the operative medial portion 72, locking pin 62 is received within proximal locking guide 73. Upon release of force to actuating pin 70, locking pin 62, under forces of spring 68, would be forced out of the proximal locking guide 73. Slide 15 remains in the concealed position until sufficient force is again applied to actuating pin 70 and slide 15.

Alternatively, when slide 15 is concealed, with respect to FIG. 6, pin 62 would initially seat within proximal locking guide 73. Upon application of appropriate forces to actuate pin 70, pin 62 moves upward, out of proximal locking guide 73. Slide 15 may then move outwardly wherein pin 62 traverses the length of medial locking guide 72 of locking guide 75 as slide 15 is extended along track 24. After sufficient movement of slide 15, pin 62 seats within distal locking guide 74 and upon removal of forces to the locking system 20, pin 62 securely seats within distal locking guide 74.

In both the fully extended and concealed positions, further sliding of slides 15 will be precluded by locking pin 62 extending into either the proximal or distal locking guide whereby additional forces applied in the direction along the length of slide 15 would not move slide 15. In the fully extended position, complete removal of slide 15 from track 24 is precluded by a blocking device, such as set screw 52. As shown in FIG. 6, openings 76 are provided at distal ends of each locking guide to permit assembly of the sign 10. Set screw 52 also serves to maintain pin 62 within the respective locking guide to prevent removal of slide 15 from frame assembly 16. Set screw 52 is positioned in the respective locking guide 75 depending on whether the sign is a right-handed or left-handed sign 10 as described below.

Regarding FIG. 8, locking channel 58 (shown in phantom) is defined by second frame member 28. Locking channel 58 extends substantially the length of frame assembly 16. In profile, as shown in FIG. 11, locking channel 58 is defined by flanges 78, 79 of second side frame member 28 wherein flange 78 has been machined, e.g., severed, along line A-A shown in FIG. 12. Tolerances of locking channel 58 are sufficient to receive locking pin 62 and to engage locking pin 62 so that it may move, against bias of spring 68, within locking channel 58.

According to a preferred embodiment, of sign 10 includes frame members 25, 26, 27, 28 and 29 which form frame 22, track 24, and slide 15 are made of aluminum and formed by any conventional method, such as extrusion methods. Indicia coupling 18, according to a preferred embodiment, is formed of an inherently flexible material; such as an acrylic styrene acrylonitrile (ASA) that is preferably injection molded. Of course, any material and/or process resulting in the members having the aforementioned configurations and achieving the desired controlled tolerances between adjacent parts may be utilized.

Also provided herein is a method for securely displaying information utilizing sign 10 including frame assembly 16. Frame assembly 16 is selected and assembled so as to include the desired number of slides 15. As such, frame assembly 16 may have any desired length. Also within the scope of the present invention, is the provision of slides 15 having varying lengths as opposed to all slides having the same length as shown. As shown in the various Figures, four slides are provided, but as is apparent to one of ordinary skill in the art, it is within the scope of the present invention to provide one or any number of slides. Moreover, although slides 15 are shown to extend from one side 28 of frame assembly 16, a pair of frame assemblies 16 may be positioned in a side-by-side manner and appropriately connected by conventional means so that slides 15 extend from both side edges of frame assembly 16. Sign 10 may include a right hand frame assembly 16 wherein second side member 28 forms the right side of frame 22 as shown, for example, in FIG. 2 or a left hand frame assembly 16, shown in FIG. 1, wherein second side member 28 forms the left side of frame 22.

The method according to the present invention therefore includes the steps of providing frame assembly 16 having a right hand or left hand frame 22 with a selected number of slides 15. Frame members 25, 26, 27 and 28 are assembled and secured by angle plates 30 as described above. The selected number of tracks 24 is applied to frame 22 and the corresponding number of slides 15 to each track 24. Prior to slide 15 being positioned on track 24, indicia coupling 18 is secured to slide 15 by locking set screw 52 secured to the appropriate locking guide 75 (depending upon whether it is a right hand or left hand sign 10).

The method also includes assembling locking system 20 by connecting a corresponding number of locking members 60. The upper most proximal connecting member 64 is removed and the locking system 20, including spring 68 and connected locking members 60, are positioned within locking channel 58 of the second side frame member 28 of frame 22. The method further includes the step of providing a set of indicia plates 40 having predetermined wording, images, and/or color imprinted thereon. Thereafter, selecting the appropriate indicia plate 40 to be positioned in the selected slide 15. Each selected indicia plate 40 is positioned in a slide 15 when slide 15 is in a substantially extended position and pressure is applied manually to grip 45 of coupling 18 as shown in FIG. 7. The indicia plate 40 is inserted into appropriate retention tracks 42 of slide 15 until contacting stop 47, 49. In some instances, such as hospitals, it may be desired that all signs 10 throughout the facility have the ability to convey the same information across all applications. In such instances, indicia plates 40 will not be frequently removed and replaced and, once indicia plate 40 is selected, it may be securely attached to slide 15 with fasteners 46, e.g., adhesive fasteners. In the illustrated embodiment, fore edge 43 of indicia plate 40 extends beyond slide 15 and is received by grip 45. The same steps are applied to each slide 15 until sign 10 provides for the selective display of information. The same steps may also be applied to change indicia plates 40 which have previously been inserted. In this regard, sign 10 is customizable.

When all indicia plates 40 are positioned, sign 10 may be manipulated by the user applying upward pressure to actuating pin 70 which is discretely positioned behind cover 11 as shown in FIG. 2. Accordingly, only persons with knowledge of the location of actuating pin 70 will be able to manipulate sign 10 so as to alter the display of the selected indicia plates 40. Individual slides may then be manipulated when actuating pin 70 is depressed (against spring 68). The user may easily determine which slides 15 to extend outward because a fore portion of each slide 15, preferably, extends beyond the frame 22. The portion of indicia plate 18 extending outward, even in the concealed position, may include wording, an image and/or be color-coded to assist the user in slide selection.

Cover 11 may be secured to frame assembly 16 by conventional means such as by screws which cooperate with apertures positioned along frame 22. The sign 10 is of appropriate overall dimensions so that it may be positioned outside of a hospital room, for example, and meet all applicable standards, such as HIPPA. The sign 10 may also be used in combination with another sign to convey a more detailed set of information. For instance, one sign 10 may be positioned outside of the room, in the hallway, and another sign 10 positioned inside the room. Sign 10 may also be mounted on a self standing structure or frame rather than a wall.

In the drawings and the specification, there has been set forth preferred embodiments of the invention and, although specific terms are employed, the terms are used in a generic and descriptive sense only and not for the purpose of limitation, the scope of the invention being set forth in the following claims.

What is claimed is:

1. A customizable display for selectively and securely displaying important information comprising:

a frame assembly;

a cover positioned on said frame assembly;

at least one track supported on said frame assembly;

at least one slide positioned on said at least one track for supporting customizable information thereon, wherein said track includes means for cooperating with said slide, wherein said slide is moveable relative to and along the length of said track, between a concealed position substantially behind said cover and an extended position; and a locking system for locking said slide in said concealed and extended positions wherein said slide includes an aft and fore edge wherein said slide fore edge, when said slide is secured in a locked position by said locking system, in said concealed position, extends beyond an outer edge of said cover so as to display a portion of said information.

2. A customizable display according to claim 1 wherein said track means includes a flange extending along a length thereof and said slide includes a medial cooperating member for cooperating with said flange.

3. A customizable display according to claim 2 wherein said slide medial member is a retention track for receiving said track flange.

4. A customizable display according to claim 1 wherein said track includes a pair of longitudinally extending shoulders extending along side edges thereof and said slide includes a correspondingly configured pair of shoulders along side edges thereof for cooperating with said track shoulders to permit said slide to move along the length of said track.

5. A customizable display according to claim 1 wherein said slide includes a surface for supporting an indicia plate bearing the information.

6. A customizable display according to claim 1 wherein said display comprises at least two of said tracks and at least two of said slides and said locking system includes a locking actuating member and a locking pin which locks said at least two slides in said extended and concealed positions, wherein said locking actuating member may be manipulated to unlock at least two of said slides.

7. A customizable display according to claim 6 wherein said locking actuating member unlocks each of said at least two slides with a single actuating force.

8. A customizable display according to claim 1 wherein said locking system includes a locking actuating member and a locking pin which locks said slide in said extended and concealed positions said frame assembly further comprises a slide coupling positioned between said slide and said track, said coupling being configured to cooperate with said locking pin.

9. A customizable display according to claim 8 wherein said slide coupling defines a locking guide for receiving said locking pin.

10. A customizable display for selectively and securely displaying information comprising:

a frame assembly;

at least one track supported on said frame assembly;

at least one slide positioned on said track, wherein said track includes means for cooperating with said slide for supporting customizable information thereon and said slide has means for cooperating with said track, said slide being moveable relative to said track, between a concealed position substantially behind said cover and an extended position; and wherein said slide comprises an indicia bearing surface on a first side and a slide coupling on a second side facing said track and said slide includes a fore edge, and wherein said slide coupling includes a flexible fore edge which extends beyond the slide fore edge wherein said coupling fore edge is moveable relative to said slide when said slide is in the substantially extended position.

11. A customizable display according to claim 10 further comprising an indicia plate and said slide further comprises means for receiving said indicia plate wherein said slide coupling fore edge may be moved way from said slide to enable said indicia plate to be inserted and removed from said slide means for receiving said indicia plate.

12. A customizable display according to claim 11 wherein said slide means for receiving said indicia plate is defined by a pair of longitudinally extending shoulders extending along side edges of said slide.

13. A customizable display according to claim 10 wherein said slide coupling defines a medial channel for cooperating with said slide cooperating means.

14. A customizable display according to claim 10 further comprising a set of indicia plates bearing the information.

15. A customizable display according to claim 10 further comprising a cover positioned on said frame assembly.

16. A customizable display according to claim 10 further comprising a locking system for locking said slide in said concealed and extended positions.

17. A customizable display according to claim 16 wherein said slide coupling defines at least one locking guide for cooperating with said locking system.

18. A customizable display according to claim 17 further comprising a blocking device which cooperates with said at least one locking guide.

19. A customizable display according to claim 18 wherein said blocking device is a set screw.

20. A customizable display according to claim 16 wherein said locking guide is defined by an elongate medial portion, a proximal locking guide and a distal guide, and said locking system includes a locking pin, said locking guide being configured to receive said locking pin.

21. A customizable display according to claim 20 wherein said locking system further comprises a spring for biasing said locking pin in said proximal and distal guides.

22. A customizable display for selectively and securely displaying information comprising:

a frame assembly;

a cover positioned on said frame assembly;

at least two tracks supported on said frame assembly; and at least two slides, each supported on a respective one of said at least two tracks, for supporting customizable information thereon, wherein said tracks each include means for cooperating with said slides, said slides being moveable relative to and along the length of said tracks, between a concealed position substantially behind said cover and an extended position; and a locking system for locking said slides in said concealed and extended positions, said locking system including a lock actuating member and a locking member which locks said at least two slides in said extended and concealed positions, wherein said locking actuating member may be manipulated to lock at least two of said slides in said concealed and extended.

23. A customizable display according to claim 22 wherein said frame assembly comprises a top frame member, a bottom frame member, a first side member and a second side frame member wherein said second side member comprises a locking channel for receiving said locking system.

24. A customizable display according to claim 23 wherein said second side frame member is configured to provide sufficient tolerances to enable said slides to be extended.

25. A customizable display according to claim 23 wherein said locking system further comprises a spring for cooperating with said locking member to bias said locking member in a locked position within said locking channel.

26. A customizable display according to claim 22 wherein said locking member is generally elongate and includes a distal member, a proximal member, and at least one outwardly extending locking pin for cooperating with said slide to lock said slide in the extended and concealed positions.

27. A customizable display according to claim 26 wherein said locking system includes first and second locking members wherein said distal member of said first locking member is configured to mate with said proximal member of said second locking member.

28. A customizable display according to claim 27 wherein said proximal member of said first locking member is removable.

29. A customizable display according to claim 26 wherein said elongate locking member includes at least two of said locking pins.

30. A customizable display according to claim 29 wherein said locking system further comprises means for biasing said at least two of said locking pins in a locked position when said slide is locked in the extended and concealed positions.

31. A customizable display according to claim 30 wherein said biasing means is a spring and said locking member and said spring are positioned within a locking channel defined by a frame member of said frame assembly.

32. A customizable display according to claim 22 further comprising a slide coupling positioned between each of said at least two slides and tracks, said slide couplings each including a flexible fore edge which is configured to be moved in a direction away from said slide when said slide is in the extended position.

33. A customizable display according to claim 32 wherein said slide coupling includes at least one locking guide extending substantially along the length thereof for cooperating with said locking member to lock said slide in the extended and concealed positions.

34. A customizable display according to claim 33 wherein said slide coupling includes at least two of said locking guides, said locking guides extending parallel to each other enabling said slide to be selectively positioned on said frame assembly such that said slide extends in a predetermined direction in said extended position.

35. A customizable display according to claim 33 wherein said locking member is generally elongate and includes at least one outwardly extending locking pin for cooperating with said locking guide to lock said slide in the extended and concealed positions.

36. A customizable display according to claim 35 wherein said locking guide is defined by an elongate medial portion, a proximal locking guide and a distal guide, said locking guide being configured to receive said locking pin.

37. A customizable display according to claim 36 wherein said locking system further comprises means for biasing said locking pin in said proximal and distal guides in the concealed and extended positions.

38. A customizable display according to claim 37 wherein said locking system further comprises an actuating member for releasing the bias of said locking pin within said locked position wherein said pin is positioned within and traverses the length of said locking guide elongate medial portion, between said proximal and distal guides.

39. A customizable display according to claim 38 wherein said actuating member has a length which extends beyond one of said frame assembly members, said length being no greater than the length of a cover portion which extends beyond said frame assembly such that said cover obscures said actuating member.

40. A customizable display for selectively and securely displaying important information comprising:

a frame assembly having at least one frame member comprising a locking channel;

a cover positioned on said frame assembly;

at least one track supported on said frame assembly; and at least one slide positioned on said track for supporting customizable information thereon, wherein said track includes means for cooperating with said slide, said slide being moveable relative to and along the length of said track, between a concealed position substantially behind said cover and an extended position; and a locking system positioned within said locking channel for locking said slide in said concealed and extended positions, said locking channel extending substantially along the length of said frame member in a direction generally perpendicular to the direction of movement of said slide on said track and said locking system further includes a lock actuating member and at least one locking member for locking said at least one slide in said extended and concealed positions, wherein said locking actuating member may be manipulated to lock said at least one slide in said concealed and extended positions.

41. A customizable display according to claim 40 wherein said locking system further comprises means for biasing said locking member in a locked position.

42. A customizable display according to claim 41 wherein said means for biasing includes a spring for cooperating with said locking member.

43. A customizable display according to claim 40 wherein said frame member includes a pair of outwardly extending flanges for defining said locking channel substantially along the length of said frame member.

44. A customizable display according to claim 40 wherein said locking system includes at least one locking member which is generally elongate and includes a distal member, a proximal member, and at least one outwardly extending locking pin for cooperating with said slide to lock said slide in the extended and concealed positions.

45. A customizable display according to claim 44 wherein said locking system includes first and second locking members wherein said distal member of said first locking member is configured to mate with a proximal member of said second locking member.

46. A customizable display according to claim 45 wherein said first locking member comprises a removable proximal member.

47. A customizable display according to claim 46 wherein said second locking member supports said lock actuating member.

48. A customizable display according to claim 47 wherein said lock actuating member has a length sufficient to extend beyond outer edges of said frame assembly.

49. A customizable display according to claim 44 wherein said elongate locking member includes at least two of said locking pins.

50. A customizable display according to claim 40 wherein said at least one track extends substantially across the width of said frame assembly.

51. A method for selectively and securely displaying important information comprising the steps of:

providing a display having a cover and a frame assembly having a plurality of slides and a locking system, said locking system comprising a locking actuating member;

mounting said cover to said frame assembly so as to obscure said lock actuating member;

accessing said lock actuating member without substantially altering the position of said cover relative to said frame assembly and actuating said lock actuating member and releasing said plurality of slides;

selecting which slides to be extended and extending the selected slides to display information; and locking the position of said slides after completion of said selecting.

52. A method according to claim 51 further comprising the steps of:

flexibly connecting a slide coupling to each of said slides;

providing a plurality of indicia plates which may be applied to said slides;

selecting desirable plates; and flexing said coupling to insert one of said indicia plates to each of said slides.

53. The method according to claim 51 wherein said actuating step for releasing said plurality of slides is a single actuating step.

* * * * *